US005768920A

United States Patent [19]

DeBevoise

[11] Patent Number: 5,768,920

[45] Date of Patent: Jun. 23, 1998

[54] CARGO LOCKING DEVICE

[76] Inventor: Bruce D. DeBevoise, 133 E. De la Guerra St., #275, Santa Barbara, Calif. 93101

[21] Appl. No.: 815,633

[22] Filed: Mar. 13, 1997

Related U.S. Application Data

[63] Continuation-in-part of Ser. No. 527,699, Sep. 13, 1995, abandoned, which is a continuation of Ser. No. 277,425, Jul. 18, 1994, abandoned.

[51] Int. Cl.[6] ..... E05B 73/00

[52] U.S. Cl. ..... 70/18; 70/49; 70/233; 70/69

[58] Field of Search ..... 70/18, 30, 49, 70/57, 58, 233–236, 63, 67, 69; 109/50–52; 248/551–553

[56] References Cited

U.S. PATENT DOCUMENTS

| | | | |
|---|---|---|---|
| 2,708,989 | 5/1955 | Bogdanski | 190/61 |
| 3,802,232 | 4/1974 | Mattson et al. | 70/234 |
| 3,827,773 | 8/1974 | Aiello | 70/234 X |
| 3,865,245 | 2/1975 | Lieb et al. | 70/234 X |
| 3,968,665 | 7/1976 | Kaufmann | 70/234 |
| 4,023,387 | 5/1977 | Gould | 70/49 X |
| 4,028,916 | 6/1977 | Pender | 70/49 X |
| 4,066,195 | 1/1978 | Dickler | 70/76 |
| 4,112,720 | 9/1978 | Green | 70/233 |
| 4,474,116 | 10/1984 | Castenada, Jr. | 109/51 |
| 4,738,341 | 4/1988 | Asano | 190/101 |
| 4,885,920 | 12/1989 | Larson | 70/49 |
| 4,896,517 | 1/1990 | Ling | 70/233 X |
| 5,156,028 | 10/1992 | Jiang | 70/233 X |
| 5,349,834 | 9/1994 | Davidge | 70/49 X |
| 5,456,443 | 10/1995 | Taafe | 248/551 |

FOREIGN PATENT DOCUMENTS

| | | | |
|---|---|---|---|
| 1032266 | 6/1953 | France | 70/69 |
| 482574 | 7/1953 | Italy | 70/69 |
| 142959 | 10/1930 | Switzerland | 70/49 |

*Primary Examiner*—Suzanne Dino Barrett
*Attorney, Agent, or Firm*—Michael G. Petit

[57] ABSTRACT

A device for permanent mounting in the bed of a truck or the like. The device consists of a cable locking assembly having a retractable cable mounted in a chassis which may be affixed to the bed of a pickup truck or to a structure such as a utility box affixed to the bed of a truck. The chassis which houses the cable lock assembly has a front panel. The front panel provides access to both the free end of the cable, the cable's free end securing sleeve, a cable recoil controlling button and a cable lock. In practice, the chassis is mounted onto the bed of a truck or onto the accessible side of a utility box. A cargo having loop means thereon is placed in the bed of the truck. The free end of the cable is removed from the chassis and is passed through the loop means of the cargo and the free end of the cable, having been threaded through the loop means on the cargo, is returned to the holding sleeve in the chassis. Thus, the device is used to secure an otherwise loose cargo present in the bed of the truck to the truck via a cable means. The device is particularly suited for applications requiring mounting of the locking device where all controls must be accessible through a single front panel.

4 Claims, 2 Drawing Sheets

CARGO LOCKING DEVICE

This is a continuation-in-part of application Ser. No. 08/527,699; filed Sep. 13 1995 and now abandoned, which is a cont. of U.S. Pat. No. 277,425, Jul. 18, 1994, and now abandoned.

BACKGROUND OF THE INVENTION

1. Field of the Invention

This invention relates to a cargo locking assembly and, more particularly, to a cable locking device suitable for mounting in a truck for securing a cargo to the truck.

2. Prior Art

Portable cable locking devices are well-known in the art. Such devices are presented in U.S. Pat. Nos. 3,228,217; 2,933,915; 3,670,535; 3,714,803; and 3,950,972. Each of these prior art cable locking assemblies employ a retractile cable capable of being secured around a fixed object and then locked to the locking device to secure the object against theft.

Foster, et al. in U.S. Pat. 4,086,795 describes a cable lock storage structure adapted for selective mounting upon a bicycle frame. Foster, et al's cable lock comprises a locking cable stored on a spring-loaded reel retractor assembly. The cable may be selectively extended from the housing to be wound through the bicycle frame and around an adjacent fixed structure to shackle the two together. The free end of the cable is adapted for selective locking engagement with a cable lock mechanism provided in the housing. Thus the cable forms a closed loop locking assembly with the housing. A pawl lock mechanism is integrally provided in the housing to selectively and lockably engage the reel retractor so as to prevent retraction of the extended cable. The pawl lock mechanism is adapted to selectively be disengaged to permit retraction of the cable into the housing for storage when not in use.

Horlacher, in U.S. Pat. No. 4,044,577 describes a retractable cable locking device similar to the aforesaid Foster, et al. device. The lock has first and second casings with a spindle mounted within one-half of the casing. The spindle provides a support for the cable. The device, as in the Foster, et al. device, has mounting brackets for mounting the locking assembly to a vehicle such as the frame of a bicycle. Both the mechanism for locking and retracting the cable as well as a spring retracting system and a pawl for selectively locking the cable in a particular position is well-described in the Foster, et al. patent and the Horlacher patent and such mechanisms are incorporated herein by reference thereto.

What is lacking in the prior art is a locking assembly wherein access to the cable, the cable locking sleeve, the retracting mechanism and the locking mechanism are all operable from controls located on, and accessible from, a single surface. Part of the reason for this is because the prior art devices, primarily developed for bicycle mounting, are designed to provide a low profile in the direction orthogonal to the plane of the bicycle and to fit substantially within the plane of the bicycle. Thus, the key, for example, is placed into the locking device in a plane perpendicular to the plane from which the cable is extended or wound. Such locking assemblies are not suitable for mounting, for example, on the surface of a utility box located in the back of a pickup truck. The reason for this is that only a single face of the utility box is available or accessible for locking and unlocking and cable manipulation. Surprisingly, prior art devices having the cable manipulation and locking functions on separate planes have not been adapted for access and operability via controls located on a single planar surface.

SUMMARY OF THE INVENTION

It is an object of the present invention to provide a cargo locking assembly adapted for mounting in a vehicle.

It is yet another object of this invention to provide a locking device wherein all necessary controls for operating the device are accessible from a single plane.

It is yet a further object of this -invention to provide a cargo locking s device having a locking mechanism with a cable which is sufficiently long to enable the cable to circumscribe the perimeter of the bed of a pickup truck or the like.

These and other objects of the invention will soon become apparent as we turn now to a brief description of the drawings and a description of the preferred embodiments.

DESCRIPTION OF THE PREFERRED EMBODIMENT

Figure 1A:
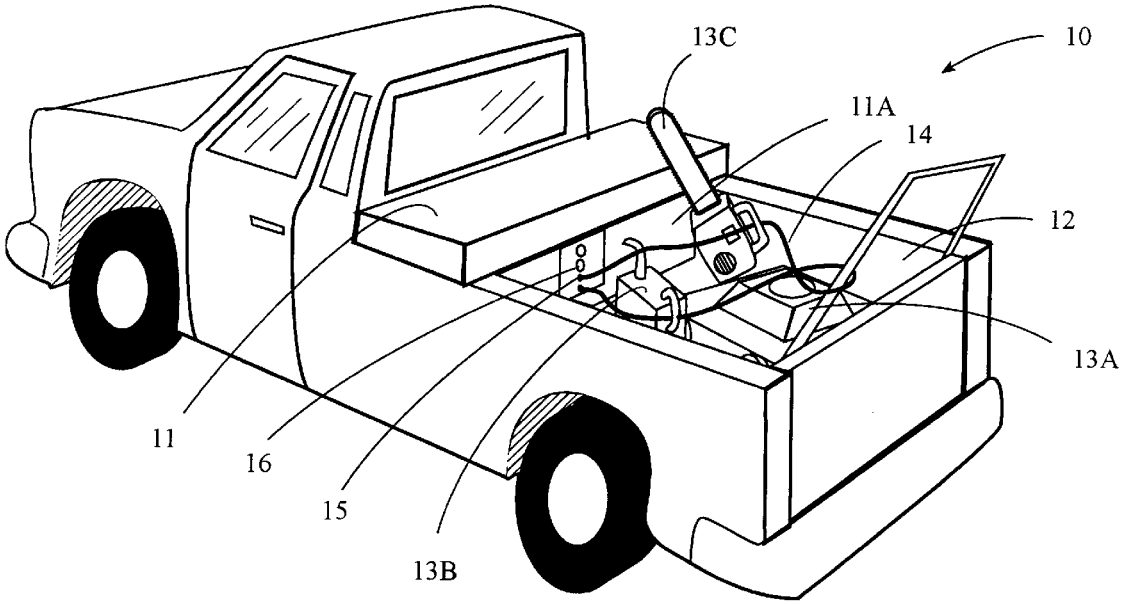
FIG. 1*a* is a perspective view of the bed of a pickup truck showing the relationship between a locking device in accordance with the present invention, a utility box permanently mounted in the bed of the pickup truck and the cargo.

FIG. 1 shows a utility vehicle, generally indicated at the numeral 10, and having a cargo-carrying bed 12. Situated within the cargo-carrying bed 12 is a utility or "job" box 11. The utility box 11 is normally located near the cab or forward portion of the bed 12. The utility box 11 normally has an upper lid which is hinged on the cab side to permit opening and access to the tools therewithin. The utility box 11 has a generally immobile accessible surface 11(*a*). The cargo in the bed 12 of the truck 10, generally indicated at 13(*a*)–13(*c*), is shown secured to a locking device 16 mounted upon the front surface 11(*a*) of the utility box 11. The cargo 13(*a*)–13(*c*) is locked to the device 16 and hence the utility box 11 by means of a cable 14, extendible from the locking device 16 which is threaded through loops integral with the cargo 13(*a*)–13(*c*).

Figure 1B:
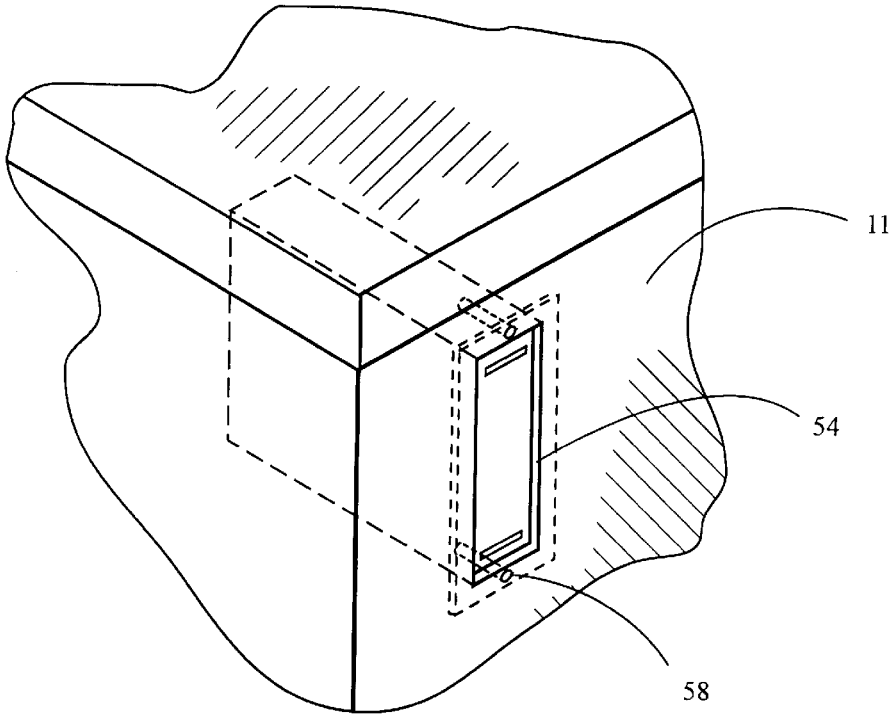
FIG. 1*b* is a partial front perspective view of the utility box with a cutout for the locking device, with the device shown in phantom lines.
Figure 2:
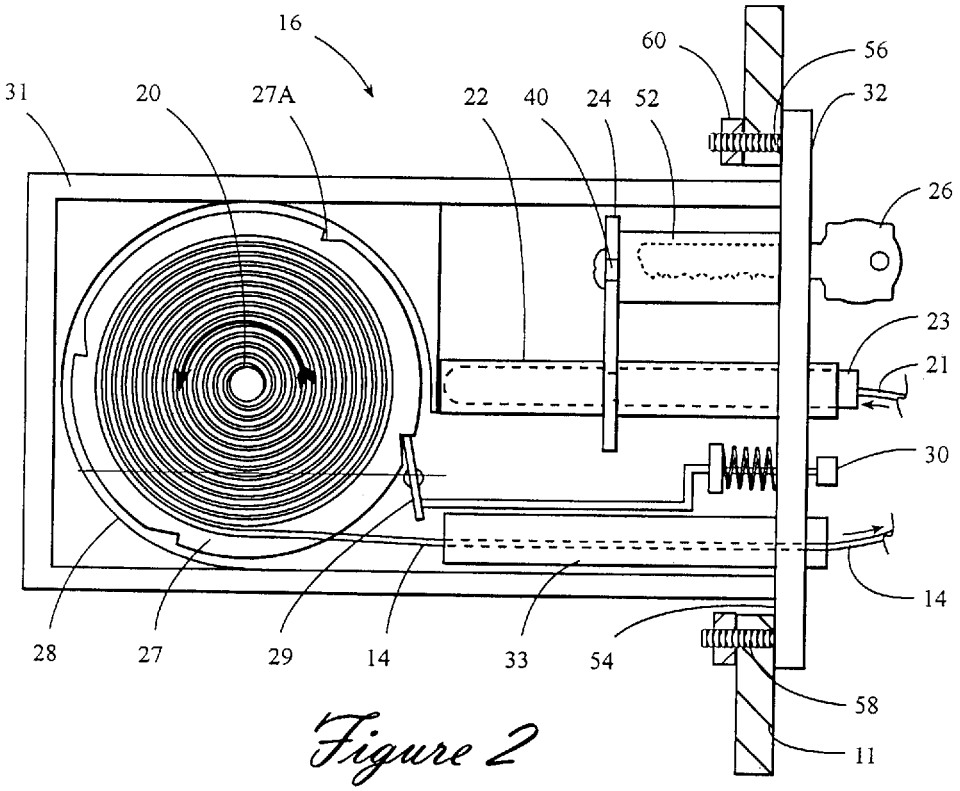
FIG. 2 is a side elevational view of the cable lock storage structure with a portion of the housing removed showing the locking cable in its stored position on the spring-loaded reel retractor assembly and further illustrating the cable lock mechanism and the lever and the recoil button-actuated pawl lock mechanism in association with the reel retractor assembly.

The mechanism of operation of a retractable cable locking device need not be repeated here as it is well-known in the art. For example, such mechanisms are described in detail in Foster, et al. (U.S. Pat. No. 4,086,795) and by Horlacher (U.S. Pat. No. 4,044,577) as previously described. It is noted that in FIG. 1, there is a single immobile accessible surface 11(*a*) on the utility box 11 in the bed 12 of the pickup truck 10. The prior art cable locking devices do not permit access to all the controls, that is; the cable manipulating controls and locking controls, through a single surface. The device 16, in accordance with the invention, provides a cable locking assembly wherein all the controls necessary for rendering the device operable for locking a cargo 13*a*, 13*b*, 13*c* to the device 16 are presented on a single planar surface 15. Such a device is shown in FIG. 2. The device, generally indicated at the numeral 16, comprises a chassis 31 with a front panel 32. The front panel 32 has mounted thereon a lock 25, a cable sleeve and pin resting position 33 and a receiver sleeve 22. A recoil button, generally indicated at 30, provides for retraction of the cable after use. The cable 14 has a fixed end 20 and a free end 21. The fixed end is attached to the axis of a reel 27. Traction on the free end 21 of the cable causes the reel to unwind, as is known in the art, and the free end, which is terminated by a pin 23, may be threaded through any one of a number of pieces 11*a*–11*c* (FIG. 1) of cargo, thereby locking them into a loop by inserting the free end pin 23 into a pin-receiving slot 22. A locking bar 24 attached to the lock 25 holds the pin 23 in position and prevents removal from the pin receiving slot. A key 26 is necessary in order to rotate the lock bar 24 to release the pin 23 from the pin-receiving slot 22. A pawl 29 is in mechanical communication with the recoil button or retraction button 30. Pressure on the retraction button 30 causes the pawl 29 to swivel and release the toothed ratchet 27(*a*) in the outer perimeter of the spool 27. When the recoil button 30 is depressed, the spool rewinds to retract the cable. Referring to FIGS. 1*b* and 2, a cutout 54 is formed in the single immobile accessible surface 11(*a*) of the utility box 11 which is sized to receive the chassis of the device, with the front panel 32 of the of the device laying flush against utility box 11. The front panel 32 is oversized relative to the size of the cutout 54. Mounting means 56, such as bolts, project from the back of the front panel 32 and are adapted to extend through holes 58 formed in the single immobile accessible surface 11(*a*). A nut 60 screws onto the bolt 56 and securely retains the front panel 32 tightly against the single immobile accessible surface 11(*a*) of the utility box 11. Other known means can also be used to retain the device 16 in the utility box 11.

Figure 3:
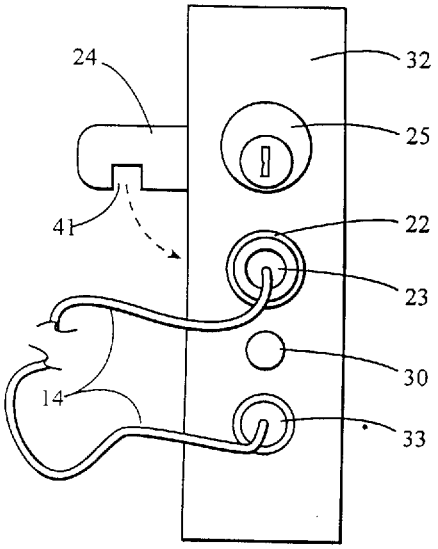
FIG. 3 is a front elevational view of the outside of the chassis shown in FIG. 2.
Figure 4:
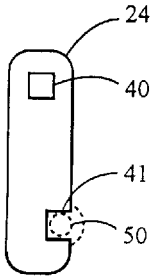
FIG. 4 is a side elevational view of the locking pin in accordance with the present invention.
Figure 5:
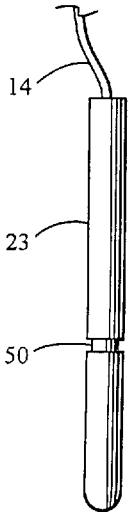
FIG. 5 is a front view elevational view of the pin.

The front view of the panel 32 is shown in FIG. 3. The front panel 32 comprises a planar sheet of a suitable weather-resistant material such as aluminum, stainless-steel or a reinforced plastic. The front panel 32 has mounted thereon and accessible thereupon a cable channel 33 having a pin resting position therein. The recoil button 30 is located generally between the pin rest position or cable channel 33 and the pin receiver sleeve 22. The lock, indicated at 25, controls the position of the lock bar 24. The lock bar 24, shown in greater detail in FIG. 4, has a slot 41 therein which slot 41 interlocks with a notch 50 in the pin 23. The pin 23 is shown in greater detail in FIG. 5. The pin 23 has a notch cut circumferentially therein generally indicated at 50. When the pin 23 is inserted into the pin receiving slot 22, the lock bar 24 may be turned by means of the key 26 to engage or disengage the slot 50 in the pin 23.

Thus, I have described a device providing a retractile cable lock assembly wherein all the controls required for operating the device are accessible from a single surface or plane. This novel configuration opens up new applications for retractile cable locking systems where access to the locking device is limited to a single planar surface.

While particular embodiments of the present invention have been illustrated and described, it will be obvious to those skilled in the art that various other changes and modifications can be made without departing from the spirit and scope of the invention. It is therefore intended to cover in the impending claims all such changes and modifications that are within the scope of this invention.

What I claim is:

1. A storage box comprising:

(a) a lid adapted to be opened or closed having a first locking means;

(b) a bottom;

(c) three sides;

(d) a flat front surface having a cutout; and (e) a retractable-cable locking device mounted within said cutout and affixed to said flat front surface of said storage box, said retractable-cable locking device further comprising a cable having a free end and a cable lock which operates independently from said first locking means, wherein said cable lock is adapted to lock said free end of said cable in mating engagement with said retractable-cable locking device.

2. The storage box of claim 1 dimensioned to be installed in the bed of a truck so that at least three sides of said storage box are adjacent to at least three wall panels comprising the truck bed, and wherein said retractable-cable locking device further comprises a flange circumscribing said cutout, said flange providing means to affix said retractable-cable locking device to said flat front surface of said storage box.

3. A storage box having:

(a) a flat front panel with a cutout therein, three sides, a bottom and a lid adapted to be opened by a first locking means integral with said storage box; and (b) a cable locking device having a retractable length of cable and a cable spool dimensioned to be rotatably mounted in said cutout with one end of said retractable length of cable affixed thereto and having retraction control means on said flat front panel operable for controlling retraction of said length of cable and a second independent locking means, said cable locking device further comprising a receptacle means dimensioned to matingly receive the distal end of said length of cable operable for retaining, locking and releasing said distal end of said length of cable and wherein the location of operational controls is restricted to said flat front panel of said storage box.

4. The storage box of claim 3 dimensioned to be installed in the bed of a truck so that at least three sides of said storage box are adjacent to at least three wall panels comprising the truck bed, and wherein said cable locking device further comprises a flange circumscribing said cutout, said flange providing means to affix said cable locking to said flat front surface of said storage box.

* * * * *